US005537086A

United States Patent [19]

Noritake

[11] Patent Number: 5,537,086

[45] Date of Patent: Jul. 16, 1996

[54] DRIVER DEVICE FOR REED SWITCH AND STRUCTURE OF MOUNTING REED SWITCH

[75] Inventor: Seiichiro Noritake, Nagano, Japan

[73] Assignee: Kabushiki Kaisha Sankyo Seiki Seisakusho, Tokyo, Japan

[21] Appl. No.: 227,383

[22] Filed: Apr. 14, 1994

[30] Foreign Application Priority Data

Apr. 15, 1993 [JP] Japan ..... 5-024962 U
Jun. 30, 1993 [JP] Japan ..... 5-183477

[51] Int. Cl.[6] ..... H01H 9/00

[52] U.S. Cl. ..... 335/207; 335/151; 335/68

[58] Field of Search ..... 335/205, 206, 335/207, 68

[56] References Cited

U.S. PATENT DOCUMENTS 3,685,041 8/1972 Kondur, Jr. ..... 340/635
3,735,298 5/1973 Colby ..... 335/206
5,054,570 10/1991 Naito et al. ..... 340/441
5,072,164 10/1991 Pruis et al. .
5,293,523 3/1994 Posey ..... 335/205

FOREIGN PATENT DOCUMENTS 1581345 12/1969 France .
3028286 6/1991 Japan .
328286 6/1991 Japan .

*Primary Examiner*—Lincoln Donovan
*Attorney, Agent, or Firm*—Sughrue, Mion, Zinn, Macpeak & Seas

[57] ABSTRACT

A driver device for a reed switch includes a reed switch including first and second reed pieces; a first magnet for magnetizing the first reed piece so as to have a specific magnetic polarity; a rotary member located close to the second reed piece; a second magnet, fixed to the rotary member, having different magnetic poles arranged in the circumferential direction, the second reed piece being located to face the second magnet.

14 Claims, 6 Drawing Sheets

DRIVER DEVICE FOR REED SWITCH AND STRUCTURE OF MOUNTING REED SWITCH

BACKGROUND OF THE INVENTION

1. Field of the Invention

The present invention relates to a driver device for a reed switch, and more particularly to a driver device for a reed switch which is driven for switching operation by using two magnets.

2. Related Art

A typical reed switch driver device of this type is disclosed in Published examined Japanese Utility Model Application No. Hei. 3-28286. The switch driver device disclosed is applied to a damper of a refrigerator. The driver device includes a motor. The rotary force of the motor is transmitted through a complex gear serving also as a reduction gear. The rotary force from the complex gear is transmitted to the final gear.

This gear is integral with a plate cam. A switch lever is urged against the outer surface of the plate cam by means of a spring. A magnet is attached to the distal end of this switch lever. A reed switch is provided facing the magnet.

When the magnet approaches to the reed switch, a pair of switch pieces are brought into a contact with each other, to set up an on state of the reed switch. When the magnet is apart from the reed switch, the pair of switch pieces separate from each other by their resilient forces. An off state of the reed switch is set up.

In the reed switch driver device thus constructed, only resilient forces of the switch pieces are used for the separation of the switch pieces one from the other for turning off the reed switch. When a locking, such as frozen and soft stick, takes place, the separation of the switch pieces fails. This results in switching failure. When the switch pieces are separated from each other, the switch pieces each cantilever supported bounces, leading to chattering.

SUMMARY OF THE INVENTION

With the view of solving the above problems, an object of the present invention is to provide a driver device for a reed switch which eliminates the switching failure caused by a locking, thereby preventing occurrence of a chattering.

According to an aspect of the present invention, there is provided that a driver device for a reed switch comprising: a reed switch including first and second reed pieces; a first magnet for magnetizing the first reed piece so as to have a specific magnetic polarity; a rotary member located close to the second reed piece; a second magnet, fixed to the rotary member, having different magnetic poles arranged in the circumferential direction, the second reed piece being located to face the second magnet.

According to another aspect of the present invention, there is provided that a reed switch mounting structure of a driver device comprising a reed switch including first and second reed pieces, a reed switch for generating a signal to stop the rotation of a motor for driving a driven member; a first magnet for magnetizing the first reed piece so as to have a specific magnetic polarity; a rotary member located close to the second reed piece; a second magnet, fixed to the rotary member, having different magnetic poles arranged in the circumferential direction, the second reed piece being located to face the second magnet, wherein a contact face defined on a motor case and the motor core of the motor on the output shaft side of the motor indirectly faces the reed switch.

The present invention thus constructed and operated has the following beneficial effects. To turn off the reed switch, the switch pieces of the reed switch are pushed away by the magnetic forces of the first magnet and the second magnet fastened to the rotary body. Further, in addition to the magnetic forces, the elastic forces of the switch pieces are used for the repulsion of the switch pieces. A reliable repulsion of these switching pieces is secured.

Even when locking, such as frozen and soft stick, takes place, the reed switch reliably operates for switching irrespective of the locking. When the reed switch is turned off, the magnetic repulsion acts on the switch pieces, in addition to the elastic forces. Therefore, no chattering takes place.

According to the invention, when the magnetic flux leaks from the contact faces of the motor case and the motor core on the output shaft side, the magnetic path is formed greatly apart from the reed switch. The reed switch is not influenced by the magnetic flux leaking from the AC motor. Accordingly, no chattering takes place in the reed switch.

Where such a structure that the motor core is partially extended outside from the contact face of the motor case, thereby forming an extended part and the reed switch is located in the extended part, is used, the chattering problem can be solved by merely changing the shape of the motor core in connection with the layout of the reed switch. The change of the motor core increases a design freedom in laying out the reed switch.

In the structure of the present invention, the magnet flux leaked from the contact surfaces alternately acts on the paired reed pieces. In this case, the leaking flux is neutralized at the contacts of the paired reed pieces, causing no chattering of the reed switch.

DETAILED DESCRIPTION OF THE PREFERRED EMBODIMENTS

First Embodiment

Figure 1:
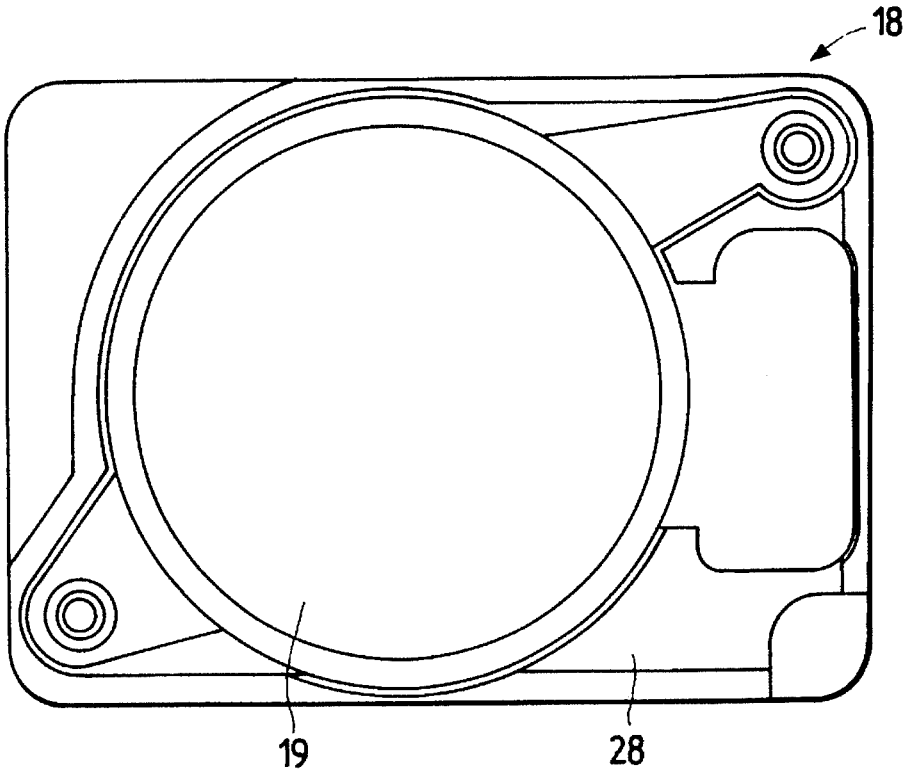
FIG. 1 is a bottom view showing a driver device, covered with a gear case, for a reed switch according to a first embodiment of the present invention.
Figure 2:
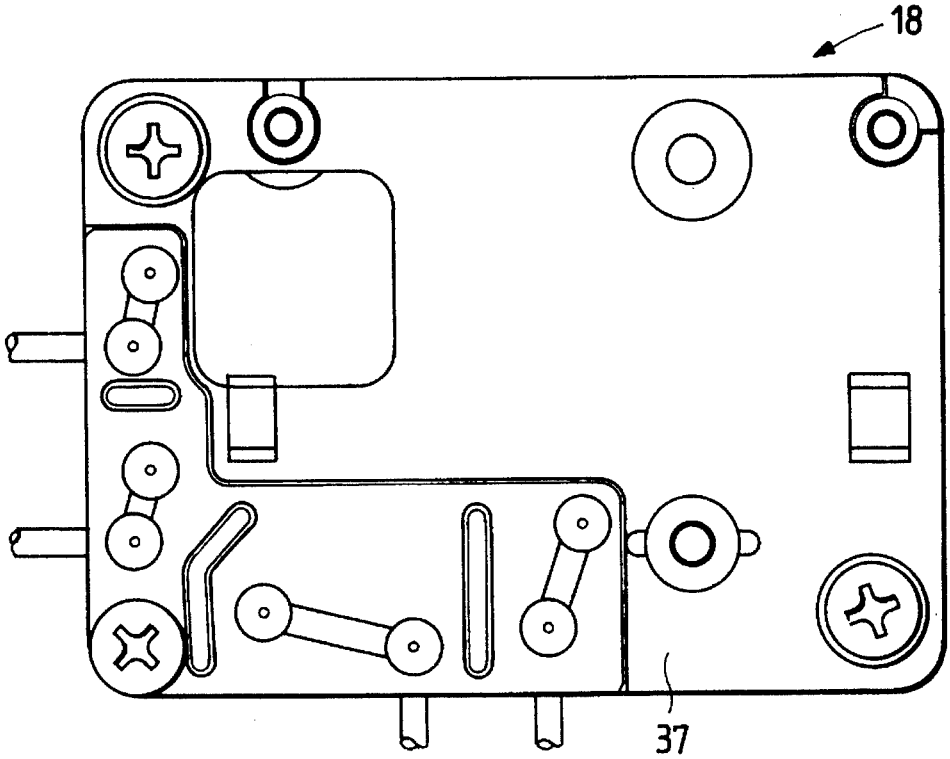
FIG. 2 is a plan view showing the driver device covered with a case cover.
Figure 3:
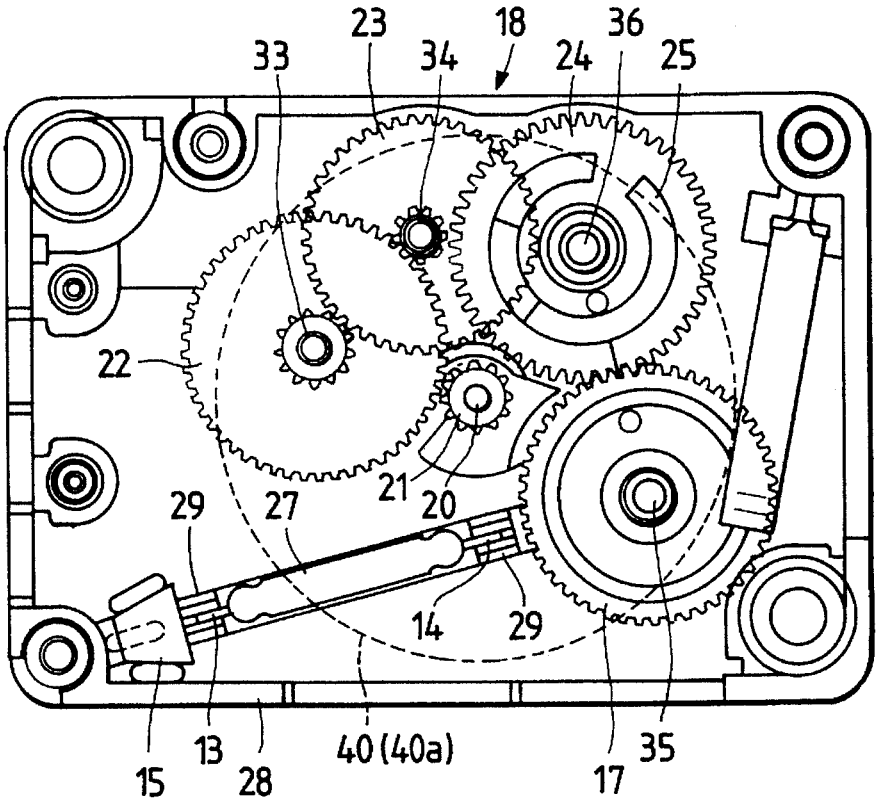
FIG. 3 is a plan view showing the driver device after a case cover is removed.
Figure 5:
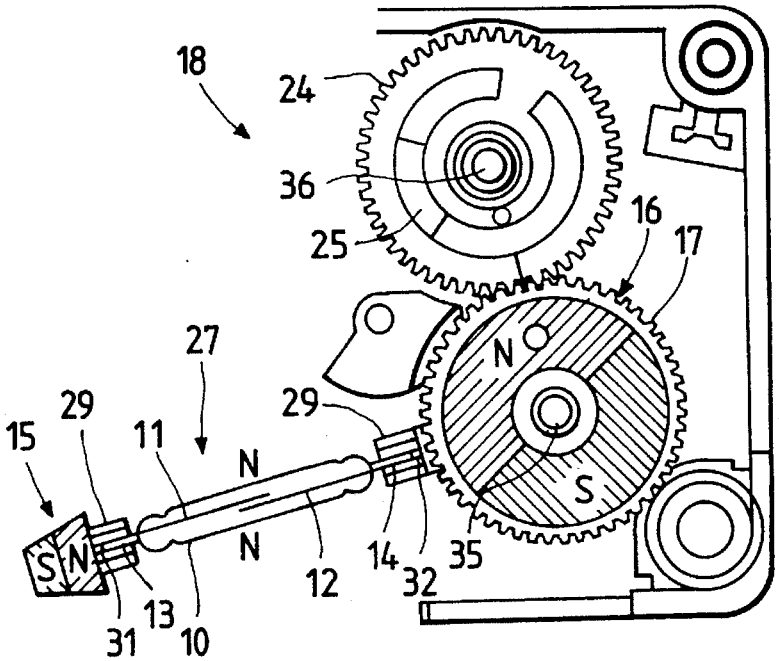
FIG. 5 is a cross sectional view showing a portion of the structure shown in FIG. 3, which the portion includes mainly magnets and a reed switch.
Figure 4:
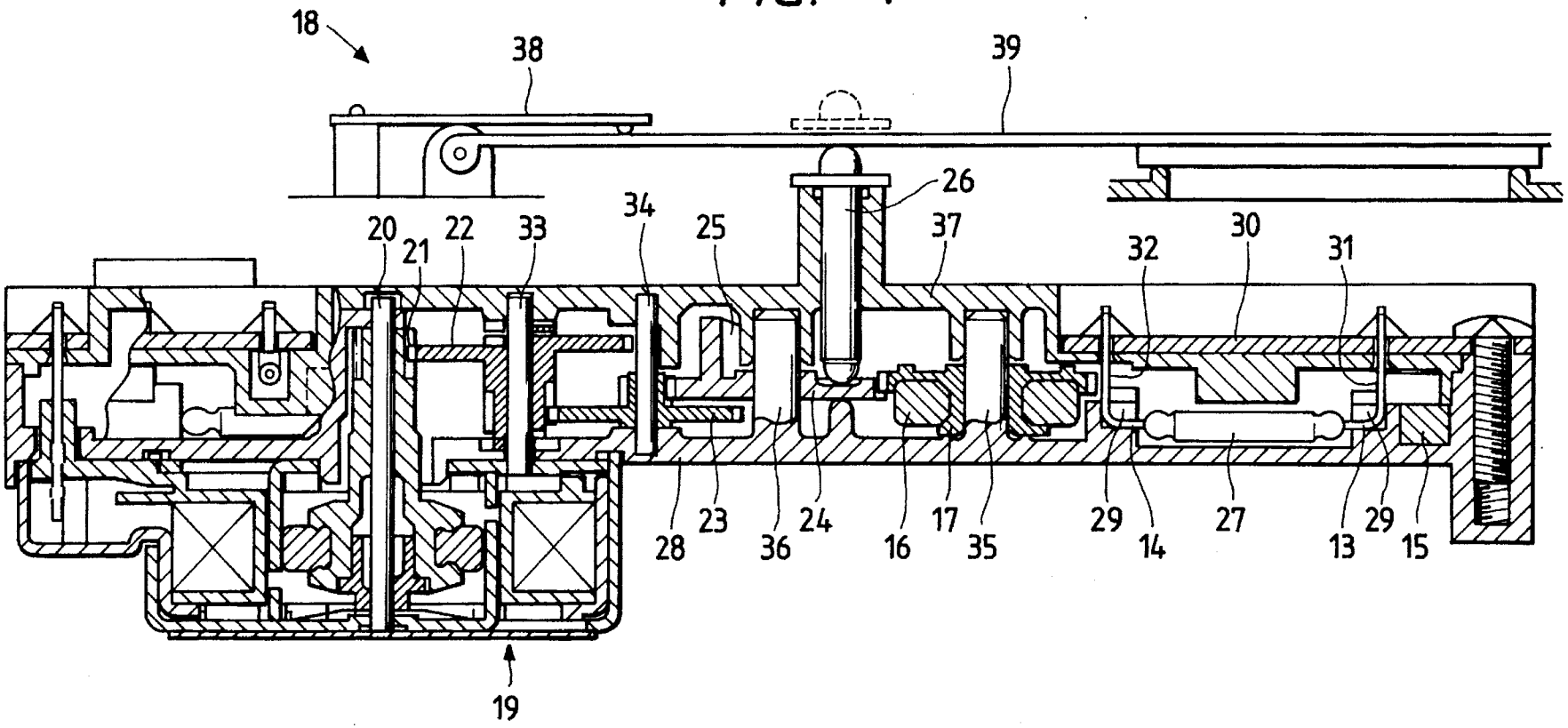
FIG. 4 is a cross sectional view showing the driver device, taken on a meshing line of gears.
Figure 6:
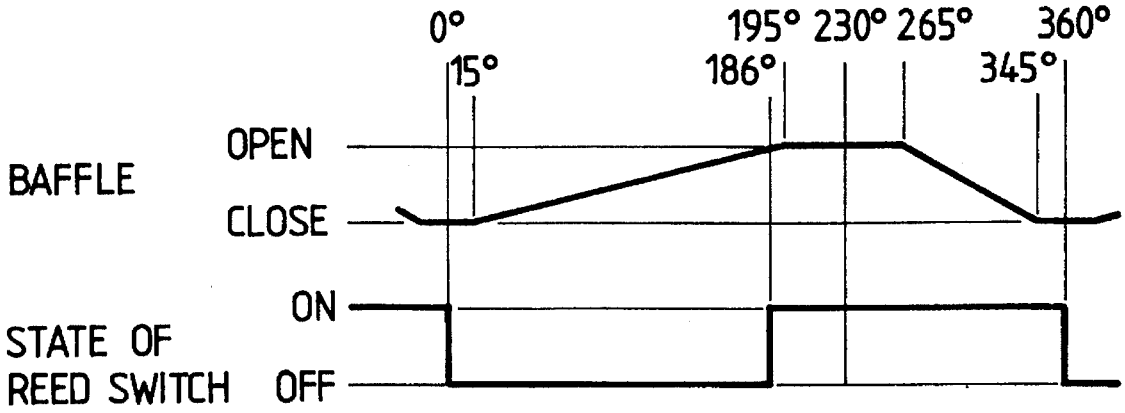
FIG. 6 is a timing chart showing the switching operation of the reed switch.

A first embodiment of the present invention will be described with reference to the accompanying drawings. FIG. 1 is a bottom view showing a driver device, covered with a gear case, for a reed switch according to a first embodiment of the present invention. FIG. 2 is a plan view showing the driver device covered with a case cover. FIG. 3 is a plan view showing the driver device after a case cover is removed. FIG. 4 is a cross sectional view showing the driver device, taken on a meshing line of gears. FIG. 5 is a cross sectional view showing a portion of the structure shown in FIG. 3, which the portion includes mainly magnets and a reed switch. FIG. 6 is a timing chart showing the switching operation of the reed switch.

This driver device for a reed switch is applied to a damper 18 of a refrigerator, for example. As shown, the driver device includes a motor 19, such as an AC motor. A pinion 21 fastened to the motor shaft 20 of the motor 19, integral with the rotor, is in mesh with the large diameter gear of the complex gear 22.

The small diameter gear of the complex gear 22 is in mesh with the large diameter gear of a complex gear 23. The small diameter gear of the complex gear 23 is in mesh with a gear 24. The gear 24 is integral with an angular end cam 25. A spindle 26 cam engages the end cam 25. The spindle 26 forcibly opens a baffle 39 as one of the driven members, which is urged in the closing direction by a spring 38 of the damper 18.

In the first embodiment, a switch 27 is turned on and off through the magnetically attracting and repelling motions of the first and second switch pieces 11 and 12 of the switch 27.

The structure to effect the switching operation of the switch will be described in detail. The switch 27 is made fast in a manner that the first and second reeds 13 and 14 of the switch 27 are inserted into and held by a reed holder 29, shaped like a groove, which is formed in the bottom of a gear case 28. The switch 27 is provided with a glass tube 10. Within the glass tube 10 the first and second switch pieces 11 and 12 made of magnetic material are extended in the opposite directions.

The inner ends of the first and second switch pieces 11 and 12 are spaced a preset distance apart as viewed in the vertical direction while partially overlap with each other as viewed in the horizontal direction. The first reed 13 is continuous to the outer end of the first switch piece 11 and made of the same material as that of the first switch piece. The first reed 13 is protruded from one end of the glass tube 10 and folded at a right angle. The folded part of the first reed 13 is electrically connected to a printed circuit board 30. Similarly, the second reed 14 is continuous to the outer end of the second switch piece 12 and made of the same material as that of the second switch piece. The second reed 14 is protruded from the other end of the glass tube 10 and folded at a right angle. The folded part of the second reed 14 is electrically connected to the printed circuit board 30.

A first magnet 15 is located in proximity to the folded part 31 of the first reed 13. Specifically, the N magnetic pole, for example, of the first magnet 15 faces the folded part 31, so that the first switch piece 11 is constantly magnetized to have the N magnetic polarity.

A gear 17 (rotary body), which meshes with the gear 24 at the gear ratio of 1:1, is provided in opposition to the second reed 14. A second magnet 16, shaped like a ring, is fastened to the gear 17 in a state that it is disposed coaxial with the gear 17. The second magnet 16 consists of a first half ring of N magnetic pole, and a second half ring of S magnetic pole, which is continuous to but turned from the first half ring by 180° of the center angle. The circumferential, outer surface of the second magnet 16 is made to approach to the folded part 32 of the second reed 14 when the gear 17 is turned.

Reference numerals 33 and 34 designate the shafts of the complex gears 22 and 23, respectively. Numerals 35 and 36 indicate the shafts of the gears 17 and 24, respectively. These shafts 33 to 36 are supported by the gear case 28 and a case cover 37.

The operation of the first embodiment will be described. FIG. 6 is a timing chart showing the switching operation of the reed switch.

In a refrigerator of the type having two refrigerating rooms, a freezing room and a chilling room, a cooled air derived from a condenser is supplied to the freezing room or the chilling room. The control of supplying the cooled air is carried out through the opening and closing operation of a baffle 39 provided between the path from the condenser to the freezing room or the path from the condenser to the chilling room. The baffle 39 is opened and closed by the motor 19 as a drive source.

The input conditions of the motor 19 for its operation and stop are temperature of the freezing room or the chilling room, and the open/close state of the baffle 39 as well. The open/close state of the baffle 39 is detected through the cooperation of the end cam 25 and the reed switch 27. The reed switch 27 detects a change of the diameter of the end cam 25, which arises from the difference of the diameters of a higher part and a lower part of the end cam 25. Through the detection of the diameter change, the reed switch 27 indirectly measures a quantity of rotation of the motor 19. At a given quantity of rotation of the motor, the reed switch 27 generates a signal to stop the motor 19.

The first switch piece 11 is magnetized, by the first magnet 15, to be always in the N magnetic polarity state. In this state, the gear 17 turns, so that the N magnetic pole of the second magnet 16 approaches to the folded part 32 of the second reed 14. Then, the second switch piece 12 is magnetized to be in an N magnetic polarity state. The first and second switch pieces 11 and 12 repel by magnetic forces, so that the reed switch 27 is turned off.

With the turn of the gear 17, the S magnetic pole of the second magnet 16 approaches to the folded part 32 of the second reed 14. The second-switch piece 12 is magnetically polarized to the S magnetic polarity. The first and second switch pieces 11 and 12 magnetically attract to close the reed switch 27.

In this way, the reed switch 27 shown in FIG. 6 is turned on and off. With the switching operation, the baffle 39 is opened and closed through the rectilinear motion of the spindle 26. The on and off states of the reed switch 27 correspond to the open and close states of the baffle 39, respectively. Hence, the on/off state of the baffle 39 can be determined on the basis of the signal level of the reed switch 27.

Thus, when the reed switch 27 is turned off, the magnetic repelling force and the elastic forces of the first and second switch piece 11 and 12 act on the first and second switch pieces 11 and 12. Therefore, the separation of the first and second switch pieces 11 and 12 one from the other is more reliable.

Even when locking, such as frozen and soft stick, takes place, the reed switch 27 reliably operates for switching irrespective of the locking. When the reed switch 27 is turned off, the magnetic repulsion acts to the first and second switch pieces 11 and 12, in addition to the elastic forces. Therefore, no chattering takes place.

The reed switch employs the noncontact structure in place of the cam engagement. A noiseless switching operation is realized. Further, the motor torque can be effectively used for the opening and closing operations of the baffle 39. The result is to eliminate the opening/closing trouble, which arises from the frozen state.

It is evident that the present invention is not limited to the first embodiment thus far described, but may variously be modified, changed and altered within the scope of the invention. The rotary body may be realized by a pulley or a cam, while the gear 17 is used for the rotary body in the above-mentioned embodiment.

In the first embodiment, the N magnetic pole of the first magnet 15, disposed in proximity to the first reed 13, constantly magnetizes the first switch piece 11 in the N magnetic polarity state. Alternatively, the S magnetic pole of the first magnet 15, disposed in proximity to the first reed 13, constantly magnetizes the first switch piece 11 in the S magnetic polarity state.

In this case, with the turn of the gear 17, the S pole of the second reed 14 approaches to the second reed 14. The reed switch 27 is turned off. When the N magnetic pole approaches to the second reed 14, the reed switch 27 is turned on. Further, the second magnet 16 may be alternately magnetically polarized in the rotation direction.

In the structure for mounting the reed switch in the read switch driver device as mentioned above, the AC motor 19 is used the gear case 28 is attached to the output shaft 20 of the motor case 40. The reed switch 27 is mounted within the gear case 6.

In the read switch mounting structure, as shown in FIGS. 3, the contact face 40*a* of the motor case 40 where it comes in contact with the motor core 50 is disposed directly facing the reed switch 27 in the location closer to the output shaft 20 of the motor 19. With this structure, part of the alternating magnetic flux developed from the motor 19 will leak from the contact face 40*a* toward the reed switch 27. As a result, chattering occurs when it is operated for switching. More specifically, when the state of the reed switch 27 changes from an ON state to an OFF state, the magnetic repulsion is weakened in the switch. When it is changed from an OFF state to an ON state, the magnetic attraction is weakened. The switching operation of the switch is instable. In this instable state, if the reed switch receives the alternating leaking magnetic flux, the reed switch chatters.

For the above reasons, following second to fourth embodiment of the present invention has an object to provide a reed switch mounting structure which can solve the chattering problem of the reed switch by shutting off the leakage of the alternating magnetic flux from the motor to the reed switch.

Second embodiment

Figure 7:
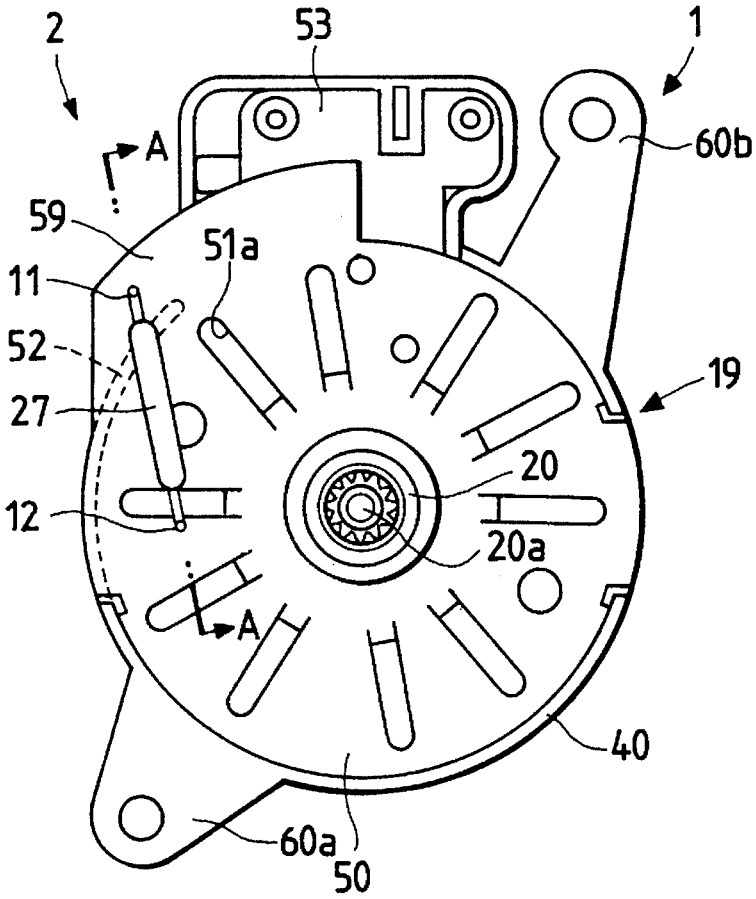
FIG. 7 is a plan view showing the structure for mounting a reed switch according to a second embodiment of the present invention.
Figure 8:
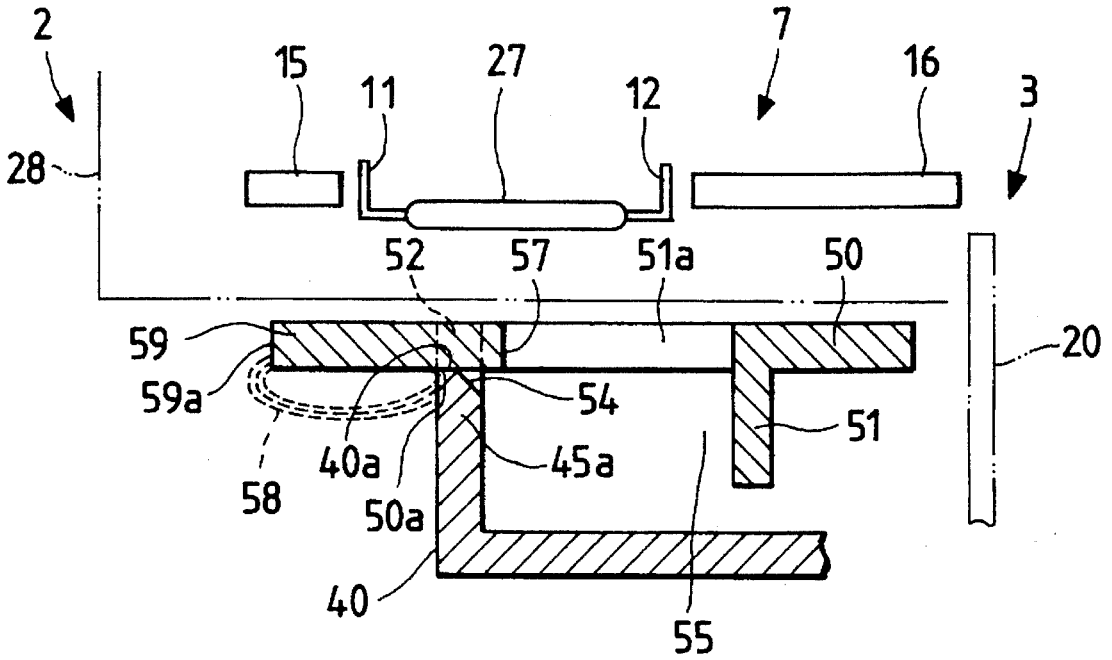
FIG. 8 is a side elevational view, partly in cross section, taken on line 8—8 in FIG. 7.
Figure 9:
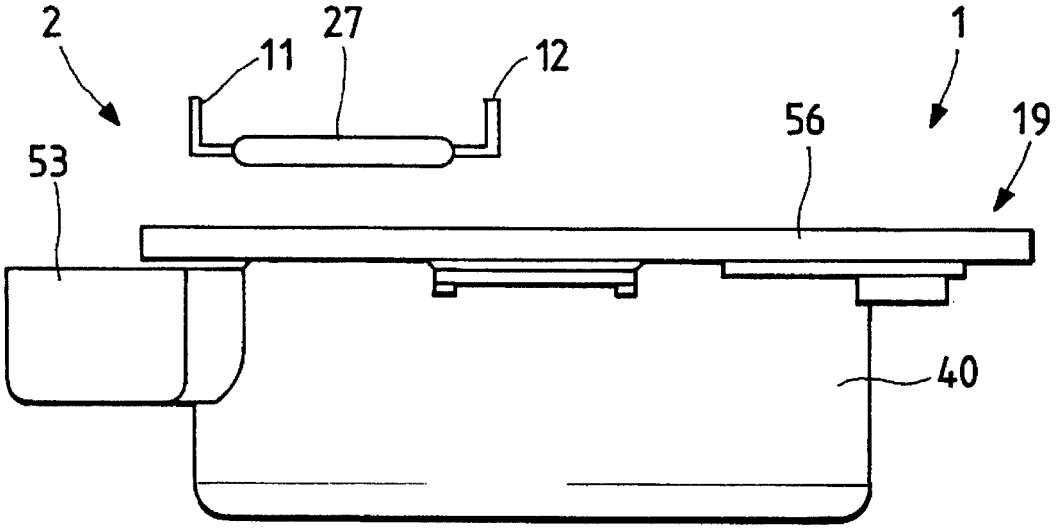
FIG. 9 is a side view, partially omitted, showing a switch mounting structure according to a third embodiment of the present invention.

As shown in FIGS. 7 and 8, a switch mounting structure 1 according to the second embodiment of the present invention is applied to a driver device 2 for a reed switch. As shown in FIGS. 8, 9 and 5, the driver device 2 includes an AC motor 19 as a motor. A gear case 28 is fastened in the location closer to the motor shaft 20 in the motor case 40. A fixed first magnet 15 is disposed facing one end of the reed switch 27 within the gear case 28. A rotatable second magnet 16 is disposed facing the other end of the reed switch 27. The second magnet 16 is turned by the motor 19. Through the rotation of the second magnet 16, the pair of reed pieces 11 and 12 are brought into contact or separated from each other by the magnetic attraction and repelling forces.

To be more specific, the first magnet 15 constantly magnetizes the first reed piece 11 in the N magnetic polarity. In this state, the gear 17 turns and the N magnetic pole of the gear 17 approaches to the folded part 14 of the second reed piece 12 (FIG. 5). Then, the second reed piece 12 is magnetized to have the N magnetic polarity. In this state, the pair of reed pieces 11 and 12 magnetically repel to be pushed away from each other. The result is the turn-off of the reed switch 27. In a situation where with the rotation of the gear 17, the S pole of the second magnet 16 approaches to the folded part 14 of the second reed piece 12, the second reed piece 12 is magnetized to have the S magnetic polarity. In this case, the pair of reed pieces 11 and 12 have the opposite polarities. Accordingly, the reed piece 11 attracts the reed piece 12 and vice versa, so that the reed switch 27 is turned on.

The switch mounting structure 1 of the reed switch driver device is constructed such that the contact faces 40*a* and 50*a* of the motor case 40 and the motor core 50 are disposed indirectly facing the reed switch 27 on the motor shaft 20 side of the motor 19. The switch mounting structure 1 of the second embodiment follows. The motor case 40 is shaped like a tube with the bottom in order to form the magnetic path for the stator. A support shaft 20*a*, which rotatably supports the rotor, is provided at the central part of the bottom of the motor case 40. Core bent portions 51 are radially extended around the support shaft 20*a*. The core bent portions 51 are each formed by cutting radially the motor core 50 and bending it downward. The motor core 50 is mounted in the opening 45 of the motor case 40. The motor core 50 is shaped like a circular plate. The motor core 50 is radially cut at a plurality of number of locations, and bent downward, thereby forming the core bent portions 51 and elongated holes 51*a*, which are radially extended as viewed from above and disposed around the support shaft 20*a*. The motor core 50 also serves as a cover for closing the opening 45 of the motor case 40.

A cutout portion 52, ranging from the center of a connector 53 to the root of a mounting portion 60*a*, is formed in the opening fringe 45*a* of the motor case 40. The cutout portion 52 has a chamfered surface 54 at the location corresponding to the layout of the reed switch 27. An extended part 59 is outwardly extended from the motor core 50 at the location corresponding to the layout of the reed switch 27. The extended part 59 is extended outside from the contact face 40*a* of the motor case 40. Provision of the chamfered surface 54 and the extended part 59 prevents the contact faces 40*a* and 50*a* of the motor case 40 and the motor core 50 from directly facing the reed switch 27.

The operation of the second embodiment will be described. In mounting the reed switch 27, the motor core 50 is first mounted on the motor shaft 20 side of the motor case 40, with fitting of the cutout portion 52 and the extended part 59. The gear case 28 is mounted on the motor shaft 20 side of the motor case 40, using the mounting portions 60*a* and 60*b*. Then, the reed switch 27 is mounted within the gear case 28.

In the reed switch mounting structure thus constructed, when the motor 19 is driven, an alternating magnetic flux leaks into the space between the inner surface of the elongated holes 51*a* of the motor core 50 and the chamfered surface 54 of the motor case 40. The magnetic path of the leaking flux emanates from the inner surface of the elongated hole 51*a* and continues to the chamfered surface 54 of the motor case 40 while being curved. Between the outer edge face 59*a* of the extended part 59 of the motor core 50 and the outer surface of the motor case 40, a magnetic path of the leaking magnetic flux emanates from the outer edge face 59*a* of the extended part 59 and is extended to the outer surface of the motor case 40 while being curved.

Thus, the magnetic paths are thus formed greatly apart from the reed switch 27. Accordingly, the reed switch 27 is less influenced by the leaking magnetic flux from the motor 19. The chattering problem of the reed switch is successfully solved. Further, the chattering problem can be solved by merely changing the shape of the motor core 50. With the change of the shape of the motor core 50, a design freedom is increased in laying out the reed switch 27.

Third Embodiment

Figure 10:
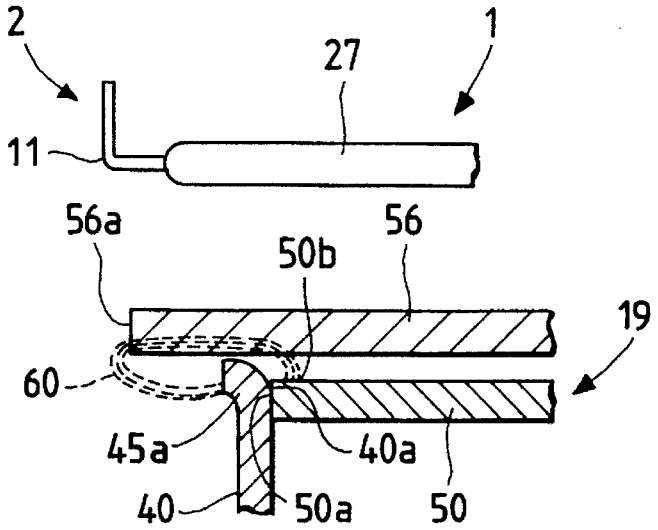
FIG. 10 is a cross sectional view showing a key portion of the switch mounting structure of FIG. 9.

The switch mounting structure 1 according to a third embodiment of the present invention is substantially the same as that according to the second embodiment. In the third embodiment, as shown in FIGS. 9 and 10, a magnetic plate 56 is located between the reed switch 27 and the motor core 50. The outer edge of the magnetic plate 56 is protruded from the opening fringe 45*a* of the motor case 40. With provision of the magnetic plate 56, the contact faces 45*a* and 50*a* of the motor case 40 and the motor core 50 are concealed from the reed switch 27.

When an alternating magnetic flux leaks from the contact faces 45*a* and 50*a* of the motor case 40 and the motor core 50, a magnetic flux 60, shaped curved, connects the upper part 50*b* of the outer edge of the motor core 50, the plate 56, the outer edge surface 56*a* of the plate 56, and the outer surface of the motor case 40. Removal of the influence of the leaking magnetic flux to the reed switch 27 and the solution of the resultant chattering problem can be solved successfully.

Fourth Embodiment

Figure 11:
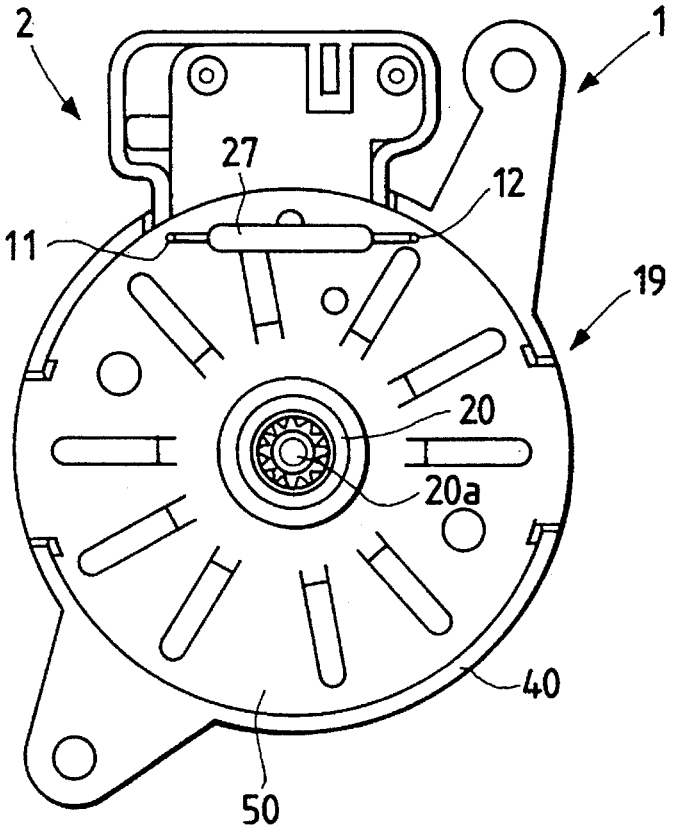
FIG. 11 is a plan view showing a switch mounting structure according to a fourth embodiment of the present invention.

A switch mounting structure 1, which is contained in the driver device 2 for the reed switch, according to a fourth embodiment of the present invention will be described with reference to FIG. 11. As shown, the reed switch 27 is located above the motor core 50. the pair of reed pieces 11 and 12 are positioned in association with the contact faces 40*a* and 50*a* of the motor case 40 and the motor core 50.

In this structure, the magnet flux leaked from the contact surfaces 40*a* and 50*a* alternately acts on the pair of reed pieces 11 and 12. In this case, the leaking flux is neutralized at the contacts of the pair of reed pieces 11 and 12, causing no chattering of the reed switch. Thus, the fourth embodiment succeeds in solving the chattering problem by merely changing the location of the reed switch 27, without any change of the motor core 50. This feature brings about the size reduction of the device.

It will be understood that the present invention is not limited to the second to fourth embodiments thus far described, but the foregoing and other changes in form and details can be made therein without departing from the spirit and scope of the invention. For example, the extended part 59 of the motor core 50 may be shaped square, while it is circular in the embodiments described above.

It is evident that the present invention is not limited to the embodiments thus far described, but may variously be modified, changed and altered within the scope of the invention. The rotary body may be realized by a pulley or a cam, while the gear 17 is used for the rotary body in the above-mentioned embodiment.

In the embodiments, the N magnetic pole of the first magnet 15, disposed in proximity to the first reed 13, constantly magnetizes the first switch piece 11 in the N magnetic polarity state. Alternatively, the S magnetic pole of the first magnet 15, disposed in proximity to the first reed 13, constantly magnetizes the first switch piece 11 in the S magnetic polarity state.

In this case, with the turn of the gear 17, the S pole of the second reed 14 approaches to the second reed 14. The reed switch 27 is turned off. When the N magnetic pole approaches to the second reed 14, the reed switch 27 is turned on. Further, the second magnet 16 may be alternately magnetically polarized in the rotation direction.

The present invention thus constructed and operated has the following beneficial effects. To turn off the reed switch, the switch pieces of the reed switch are pushed away by the magnetic forces of the first magnet and the second magnet fastened to the rotary body. Further, in addition to the magnetic forces, the elastic forces of the switch pieces are used for the repulsion of the switch pieces. A reliable repulsion of these switching pieces is secured.

Even when locking, such as frozen and soft stick, takes place, the reed switch reliably operates for switching irrespective of the locking. When the reed switch is turned off, the magnetic repulsion acts on the switch pieces, in addition to the elastic forces. Therefore, no chattering takes place.

As seen from the foregoing description, according to the present invention, the reed switch mounting structure is constructed such that the contact faces 40*a* and 50*a* of the motor case 40 and the motor core 50 indirectly face the reed switch 27. Therefore, the magnetic flux leaked from the AC motor fails to reach the reed switch, causing no chattering of the reed switch.

Where such a structure that the motor core is partially extended outside from the contact face of the motor case, thereby forming an extended part and the reed switch is located in the extended part, is used, the chattering problem can be solved by merely changing the shape of the motor core in connection with the layout of the reed switch. The change of the motor core increases a design freedom in laying out the reed switch.

According to the present invention, both ends of the reed switch are positioned at the contact faces of the motor case and the motor core of the AC motor. The chattering problem can be solved without change the motor core. No change of the motor core brings about the size reduction of the device.

What is claimed is:

1. A driver device for a reed switch comprising:

a reed switch including first and second reed pieces;

a first magnet for magnetizing the first reed piece so as to have a specific magnetic polarity;

a rotary member located close to the second reed piece;

a second magnet, fixed to the rotary member, having different magnetic poles arranged in the circumferential direction, the second reed piece being located to face the second magnet.

2. The driver device as claimed in claim 1, wherein the reed switch generates a signal to stop the rotation of a motor for driving a driven member.

3. The driver device as claimed in claim 2, wherein the motor is an AC motor.

4. The driver device according to claim 2, in which the driven member includes a baffle of a damper of a refrigerator.

5. A reed switch mounting structure of a driver device comprising:

a reed switch including first and second reed pieces, the reed switch for generating a signal to stop the rotation of a motor for driving a driven member;

a first magnet for magnetizing the first reed piece so as to have a specific magnetic polarity;

a rotary member located close to the second reed piece;

a second magnet, fixed to the rotary member, having different magnetic poles arranged in the circumferential direction, the second reed piece being located to face the second magnet, wherein a contact face defined on a motor case and the motor core of the motor on the output shaft side of the motor indirectly faces the reed switch.

6. The switch mounting structure as claimed in claim 5, in which the motor is an AC motor.

7. The switch mounting structure as claimed in claim 5, in which the driven member is a baffle of a damper of a refrigerator.

8. A reed switch mounting structure of a driver device comprising:

a reed switch including first and second reed pieces, a reed switch for generating a signal to stop the rotation of a motor for driving a driven member;

a first magnet for magnetizing the first reed piece so as to have a specific magnetic polarity;

a rotary member located close to the second reed piece;

a second magnet, fixed to the rotary member, having different magnetic poles arranged in the circumferential direction, the second reed piece being located to face the second magnet, wherein a motor core of the motor is partially extended outside from the contact face of a motor case of the motor to form an extended portion, and the reed switch is located in the extended part.

9. The switch mounting structure as claimed in claim 8, in which the motor is an AC motor.

10. The switch mounting structure as claimed in claim 8, in which the driven member is a baffle of a damper of a refrigerator.

11. A reed switch mounting structure of a driver device comprising:

a reed switch including first and second reed pieces, a reed switch for generating a signal to stop the rotation of a motor for driving a driven member;

a first magnet for magnetizing the first reed piece so as to have a specific magnetic polarity;

a rotary member located close to the second reed piece;

a second magnet, fixed to the rotary member, having different magnetic poles arranged in the circumferential direction, the second reed piece being located to face the second magnet, wherein both ends of the reed switch are positioned at the contact faces defined at the motor case and the motor core of the motor.

12. The switch mounting structure as claimed in claim 11, wherein the motor is an AC motor.

13. The switch mounting structure as claimed in claim 11, wherein the driven member is a baffle of a damper of a refrigerator.

14. A driver device for a reed switch comprising:

a reed switch including first and second reed pieces;

a first magnet for constantly magnetizing the first reed piece to have a magnetic polarity chosen from S magnetic polarity and N magnetic polarity;

a rotary member located close to the second reed piece;

a second magnet, fixed to the rotary member, having N magnetic poles and S magnetic poles arranged circumferentially about the rotary member, the second reed piece being located to face the second magnet so as to be substantially constantly magnetized;

said second reed piece being alternately magnetized with one of S magnetic polarity and N magnetic polarity.

* * * * *